United States Patent [19]

Hou et al.

[11] 4,044,671

[45] Aug. 30, 1977

[54] DUPLICATING APPARATUS EMPLOYING MODULATOR SCREEN CYLINDER

[75] Inventors: Shou L. Hou; John D. Blades, both of Chagrin Falls, Ohio

[73] Assignee: Addressograph-Multigraph Corporation, Cleveland, Ohio

[21] Appl. No.: 649,786

[22] Filed: Jan. 16, 1976

Related U.S. Application Data

[63] Continuation of Ser. No. 493,216, July 31, 1974, abandoned.

[51] Int. Cl.[2] ..... B41F 15/08

[52] U.S. Cl. ..... 101/129; 101/116; 101/DIG. 13; 346/153; 355/3 R

[58] Field of Search ..... 101/114, 116, 122, 129, 101/127, 128.2, 128.3, 128.4, 426, DIG. 13; 346/74 J; 355/3 R, 3 DD, 16; 178/6.6 A

[56] References Cited

U.S. PATENT DOCUMENTS

| | | | |
|---|---|---|---|
| 2,590,321 | 3/1952 | Huebner | 101/116 |
| 3,402,658 | 9/1968 | Opdycke | 101/129 |
| 3,647,291 | 3/1972 | Pressman et al. | 101/DIG. 13 X |
| 3,779,166 | 12/1973 | Pressman et al. | 101/DIG. 13 X |
| 3,788,221 | 1/1974 | Borneman | 101/116 |
| 3,898,085 | 8/1975 | Suzuki et al. | 355/3 R X |

*Primary Examiner*—Edgar S. Burr
*Assistant Examiner*—R. E. Suter
*Attorney, Agent, or Firm*—Sol L. Goldstein

[57] ABSTRACT

A duplicating apparatus is equipped with a photoconductive modulator screen cylinder for making reproductions of a graphic original on a dielectric receiving medium utilizing aperture-controlled electrostatic printing techniques. Means is provided for creating a charge distribution system on the surface of the modulator corresponding to an image to be reproduced from the graphic original. The apparatus also comprises charging means for projecting gas ions against the modulator screen cylinder, electrode means for collecting the gas ions selectively transmitted by the modulator screen cylinder on the dielectric receiving medium and means for developing the dielectric receiving medium to create a visible image.

6 Claims, 3 Drawing Figures

DUPLICATING APPARATUS EMPLOYING MODULATOR SCREEN CYLINDER

This is a continuation, division of application Ser. No. 493,216 filed July 31, 1974 now abandoned.

BACKGROUND OF THE INVENTION

Electrophotographic reproduction techniques for making reproductions of graphic originals using a photoconductive medium are well known. One such technique is directed to the use of a foraminated device or screen comprising a conductive layer, a photoconductive layer and a superposed insulative layer capable of having stored thereon charge patterns corresponding to light and dark areas of a graphic original.

The layer charges are modified in accordance with an image to produce blocking and unblocking fields controlling the apertures in the screen in accordance with the image to be reproduced. The conductive screen layer is maintained at a potential, usually during charging and printing, and a propulsion field is provided for directing charged printing particles towards the screen.

The charged printing particles pass through the screen where the apertures are not blocked by the blocking fields and also pass through apertures which are partially blocked, but in fewer numbers. The charge pattern modulates the flow of the printing particles through the screen to a print receiving medium, via an airgap, for subsequent development by conventional techniques.

In another aperture-controlled electrostatic printing system there is provided a photoconductive screen as described above including means for deploying oppositely poled electrostatic charges across the screen, and image projecting means for modulating the charge on the screen in accordance with a light image received thereon. However, this system includes a corona source for projecting gas ions through the unblocked apertures in the screen, and through the partially blocked apertures but in fewer numbers, to an image receiving medium for subsequent development by any conventional means.

Although electrostatic screen printing techniques are known in the art, lacking in the art is any showing of an arrangement for incorporating the screen technology into practical machine configurations suitable, for example, for copier-duplicator or reader-printer machines. Thus, because of the requirement of mechanical integrity of the photoconductive screen it does not lend itself to drum or cylinder configuration of rigid construction critical for screen drum printing. Therefore, in the known devices the photoconductive screen is normally in the form of an endless belt trained about a plurality of rollers for supporting the screen.

Such an arrangement requires that the photoconductive screen be driven intermittently to permit imaging the copy sheet at a printing station or, if the screen is to be continuously in motion, it is necessary to synchronize the motion of the screen with the travel of the copy sheets past the printing station. In either case, the known constructions result in fairly complex and expensive devices which are not suited to or feasible for incorporation into a compact, high-speed copier of practical machine configuration.

SUMMARY OF THE INVENTION

The duplicating apparatus of the present invention as described herein is directed to an imaging system utilizing a modulator, in the form of a screen cylinder, having the capability of selectively passing therethrough charged particles, such as gas ions, in accordance with a pattern that corresponds to the image and non-image areas of a graphic original. The apertured modulator is formed from a metal screen overcoated with a photoconductor which is overcoated with an insulating layer. The response of the photoconductive medium in such an apertured structure is the same as is experienced in conventional electrophotographic imaging techniques in that the photoconductive layer can be charged, thereby rendering it sensitive to electromagnetic radiation, and thereafter exposed to a pattern of light and shadow to create an electrostatic charge pattern thereon. Such foraminated structures are known in this art as photoconductive screens, modulators and apertured photoconductive materials.

It will be appreciated that while a three-layer screen is described, the construction of this invention is applicable to any type of photoconductive screen having utility in selectively passing charged particles therethrough. For example, a simple screen may be used wherein only one side of the screen is coated with a photoconductor. If the other side of the screen is coated with an insulator and a metal film, there results a four layered structure and five layers with a supplementary electrode. A three-layer modulator of the type referred to herein is described in U.S. Pat. No. 3,986,871 in the name of John. D. Blades and Jerome E. Jackson granted Oct. 19, 1976, and assigned to the same assignee as this invention.

The technique whereby such a charge image is created on a dielectric material, such as a treated sheet of paper, involves disposing the modulator bearing its charge distribution system in the environment of an arrangement of electrodes which includes a corona emission electrode adjacent the metal side of the modulator for creating gas ions in air which are directed into the apertures of the modulator, and a collection electrode disposed on the side opposite facing and immediately adjacent the insulating surface for directing the ions towards a sheet of dielectric paper adjacent the collection electrode. The ions which are permitted to pass through the modulator are collected on the dielectric material and developed into a visible image.

Such modulator construction permits the creation of a charge distribution system on the insulating layer by first applying a blanket electrostatic charge of one polarity to the surface of the insulating layer, which is then followed by the simultaneous application of a charge as applied from an AC corona emission electrode and the projection thereon of a pattern of light and shadow. This results in an equipotential level in the light struck areas of the modulator and distributes the charges in the dark areas so that they are at an equipotential level. The modulator is given a final flood illumination step causing charges in the photoconductive layer, which correspond to the dark areas of the graphic original, to be conducted to ground leaving a residual charge on the surface of the insulating layer and a corresponding charge bound at the interface between the insulating layer and the photoconductive layer.

Alternatively, the charged surface may be exposed to a pattern of light and shadow with sequential application of a charge as applied from an AC corona electrode. This results in an equipotential level in the dark areas of the modulator and distributes the charges in the light-struck areas so that they are also at an equipotential level.

The foregoing described charge distribution system results in electric fields corresponding to the pattern of light and shadow generated by illuminating the graphic original. The electrical fields are the result of the dipole charge created across the insulating layer. The result is that in the vicinity of an aperture a charged particle or an ion which encounters such a field may be either blocked, accelerated or propelled through the aperture depending upon the strength and the direction of the field.

To achieve control of the gas ions, the modulator is placed close to the ion collecting medium. Such a collecting medium is under the influence of a collecting electrode. In the present invention, the collecting electrode is provided with a curved surface for supporting the collecting medium for travel in a curved path. The collecting electrode referred to herein is described in U.S. Pat. No. 3,955,128, issued May 4, 1976 in the name of Alexander C. Wu and Shou L. Hou, and assigned to the same assignee as this invention.

Hence, there is provided an ion projection assembly in which a modulator is positioned between an emission electrode establishing a field between the modulator and the electrode which directs gas ions towards the base layer side of the modulator (adjacent the insulating surface) which similarly produces a field whose direction is perpendicular to the collecting surface. Associated with the collecting electrode is a collecting medium such as a sheet or web of dielectric material which receives the gas ions projected or transmitted through the modulator. Upon completion of the collection of the ions on the dielectric paper, a visible image is developed by conventional developing techniques.

The present invention provides a duplicating apparatus equipped with a photoconductive modulator screen cylinder for making reproductions of a graphic original on a dielectric receiving medium utilizing aperture-controlled electrostatic printing techniques. Slit scan exposure means and charging and illuminating means are provided for creating a charge distribution system on the surface of the modulator corresponding to an image to be reproduced from the graphic original. Further, the apparatus includes an emission electrode for projecting gas ions against the screen cylinder, and a collecting electrode for collecting the gas ions selectively transmitted by the screen cylinder on the dielectric receiving medium in contact with the collecting electrode. Suitable developing means is provided for developing the dielectric receiving medium to create a visible image, and fixing means fixes the developed image to provide a permanent image.

It is an object of the present invention to provide a duplicating apparatus employing a modulator screen cylinder for producing a multitude of reproductions from only a single imaging operation in which the charge distribution system was created on the surface of the modulator screen cylinder.

Another object of the invention is to provide a duplicating machine for making electrostatic copies of an original document utilizing a rotatable modulator screen cylinder, and means for projecting or selectively transmitting either printing particles or gas ions from the surface of the screen cylinder onto a dielectric receiving medium in the form of a sheet or a web of coated paper.

Another object of the invention is to provide a duplicating apparatus comprising a rotatable drum or cylinder for securely supporting the modulator screen such that the outer surface of the screen represents a locus of points equidistant from the axis of rotation of the cylinder.

A further object of the invention is to provide an apparatus which permits the aperture-controlled electrostatic printing technology to be incorporated into practical machine configurations such as, for example, high speed copier-duplicators and engineering reader-printer machines.

Other objects, features and advantages will become apparent to those skilled in the art from the following detailed description.

IN THE DRAWING

In FIG. 1 is a schematic of a typical electrostatic aperture screen printing apparatus employing a modulator screen cylinder in accordance with the present invention;

DESCRIPTION OF THE PREFERRED EMBODIMENT

Figure 1:
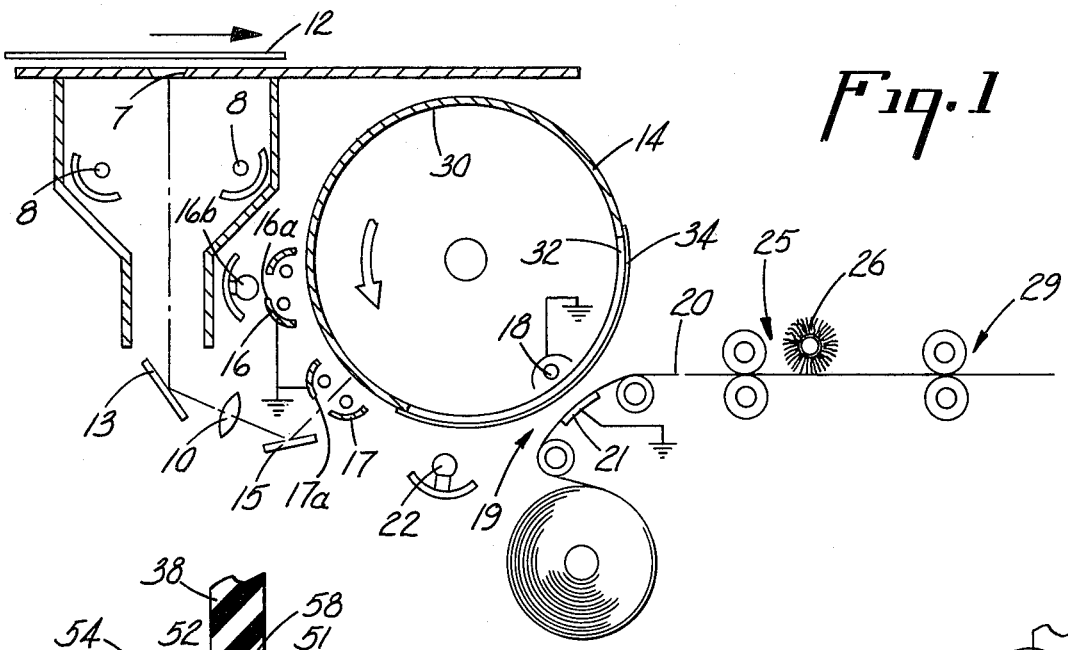

FIG. 1 illustrates a duplicating apparatus employing a modulator screen cylinder for making reproductions of an original on dielectric material utilizing aperture-controlled electrostatic printing techniques. As shown therein, there is provided a pair of lamps 8 for directing electromagnetic radiation onto an original document 12 which is adapted to move past an aperture 7 so as to effect an incremental or slit exposure of the graphic original as it moves past the aperture 7, thereby casting a pattern of light and shadow onto a reflective surface 13 in direct alignment with the aperture 7. A lens system 10 is in optical communication with the reflective surface 13 so that the pattern is projected onto a second reflective surface 15 and onto a photoconductive screen cylinder or drum 14. As described hereinabove, the modulator is of the three-layerd construction comprising a conductive metal layer, an intermediate photoconducting layer and an insulating layer, having the capability of sustaining a charge distribution system on its surface for extended periods of time. It is understood that other foraminated structures may be used, such as a two-layered construction which requires different processing steps to create a charge pattern on its surface capable of discriminating the passage therethrough of impinging charged particles, but which nonetheless can take full advantage of the apparatus of the present invention.

The slit scan exposure of the document 12 is synchronized with the speed of rotation of the screen cylinder 14 such that the travel of the document 12 during scanning corresponds with the speed of the cylinder. Although the speed of the cylinder is variably adjustable between 0 and about 30 inches per second, it has been experienced that the printing operation can be effected at a higher speed than the scanning-exposure operation. Thus, the speed of the screen cylinder 14 is set to correspond with the relatively slow movement of the document 12 being scanned and thereafter, upon completion of the scanning operation, the speed of the cylinder 14 is increased and synchronized with the speed of travel of a paper web 20 during the printing operation. Normally, the paper web 20 is advanced only during printing and is maintained stationary during the scanning-exposure operation.

There is disposed about the surface of the screen cylinder 14 the various instrumentalities necessary for creating the charge distribution system on its surface. A corona charging device 16 is the first such instrumentality in the processing line up. The corona charging device 16 is equipped with a longitudinal opening 16*a* in the roof of the conductive shield to provide a passageway for electromagnetic radiation to be directed from a light source 16*b* against the surface of the modulator screen 14 simultaneously with the initial charging step. The simultaneous application of a blanker electrostatic charge accompanied by illumination conditions the photoconductive layer with the power rectifying properties and at the same time erases any charges remaining from the previous imaging cycles.

As the modulator screen drum 14 rotates in the direction of the arrow shown in FIG. 1, it next encounters an AC corona 17, similar to the corona charging device 16, which is equipped with a longitudinal opening 17*a* in its roof to provide an accessway for the pattern of light and shadow corresponding to the intelligence of the graphic original 12 to be directed onto the modulator screen simultaneously with the AC charging.

Flood illumination of the photoconductive surface is achieved by activating an electromagnetic radiation source 22 thereby producing the final charge distribution system capable of selectively passing charged particles through the modulator screen cylinder 14.

A corona charging device 18 is positioned within the screen cylinder 14 adjacent a charged particle imaging station (CPIS) 19 whereat gas ions are projected against the screen cylinder. A collecting electrode 21 of the kind, for example, described in the aforementioned application, is positioned externally of the drum 14 at the CPIS 19 in opposed relation with the corona 18 for collecting the gas ions selectively transmitted by the screen cylinder on the image receiving medium or dielectric paper web 20 in contact with the electrode 21. In order to prevent distortion of the image on the web 20, which would result if the web 20 at the CPIS 19 traveled in a straight line path with respect to the curved surface of the drum 14, the collecting electrode 21 is provided with a curved surface for supporting the web 20. This arrangement of ion optics causes the ions projected through the screen to follow the proper electric field between the screen and the web so as not to cause distortion of the image on the web 20.

There is further provided a developer station 25 in which a magnetic brush 26 is employed for developing the latent image on the paper 20 as the paper is advanced from the CPIS 19 and through the developer station 25. The toner can be either the conventional dry developer or liquid developer formulations which are well known in this art. The type of developer formulation will depend on the polarity of the charged particles collected on the paper and whether a positive reproduction or a reversal copy is desired. Following the development step, the paper 20 is passed into the nip of a pair of pressure rollers 29, or some other form of fixing means, to fuse the toned image on the paper web 20.

In the operation of such a device, actuation of a motor drive means is followed by activation of the corona charging device 16, rotation of the screen cylinder 14 and energization of the illuminating means 8. The corona device 16 applies a blanket electrostatic charge onto the insulating surface of the photoconductive screen drum 14. The projection of the pattern of light and shadow generated from the slit scan exposure of the original 12 is projected along a path through the AC corona generator 17. The projection of the pattern of light and shadow occurs simultaneously with the emission of gas ions from the AC corona generator 17.

The action of AC charges is to erase the charges on the insulating surface and at the same time render the light struck areas of the photoconductor conductive causing any charges bound at the interface between the insulator and the photoconductor to be held to ground.

As the drum rotates in the direction of the arrow it next encounters the flood illumination of its surface by the lamp 22 which now renders conductive the remaining portions of the photoconductor corresponding to the shadow portions of the projected image. As a result of the flood illumination there remains a charge pattern on the insulting surface which produces the necessary fields across the apertures resulting in either blocking gas ions or permitting them to be transmitted depending on the polarities of the charges deposited by the corona 16 and the polarity of the gas ions generated by the corona 18.

As mentioned supra, this arrangement may be altered so that the electrostatic charge on the screen is dissipated in those areas corresponding to the image aeas of the document 12 and only those charges remain on the surface of the photoconductive screen cylinder 14 which correspond to the background areas of the document 12.

In response to 90° of rotation of the screen cylinder 14, the corona device 18 is activated and the paper web 20 is advanced at a velocity in synchronism with the speed of the screen cylinder 14. At the CPIS 19 the corona device 18 projects charged ions against the modulator screen corresponding to the image areas of the document 12. The ions projected against the screen are selectively transmitted by the screen and collected on the paper web 20, in contact with the electrode 21, to form thereon an electrostatic latent image corresponding to the document 12 being copied. Thereafter, the paper web 20 is advanced through the developer station 25 where the latent image is developed into a visible image by magnetic brush 26. The charge pattern on the insulating surface remains under normal room light and the subsequent rotation of the drum 14 will produce multiple reproductions of the graphic intelligence on the original without further imaging. In other words, after the permanent image has been produced on the drum 14, the various image producing instrumentalities such as, DC corona 16, slit scan exposure and AC corona 17 are deactivated with only the DC corona 18 being operative.

It will be appreciated that many hundreds of reproductions can be reproduced in this manner utilizing the same latent image created on the drum 14 during the first revolution thereof.

It will be understood that while the imaging process was described in terms of a three-layered modulator the drum construction of this invention can be utilized with a wide range of screens capable of modulation of charged particles, including toner particles and not only gas ions.

Figure 2:
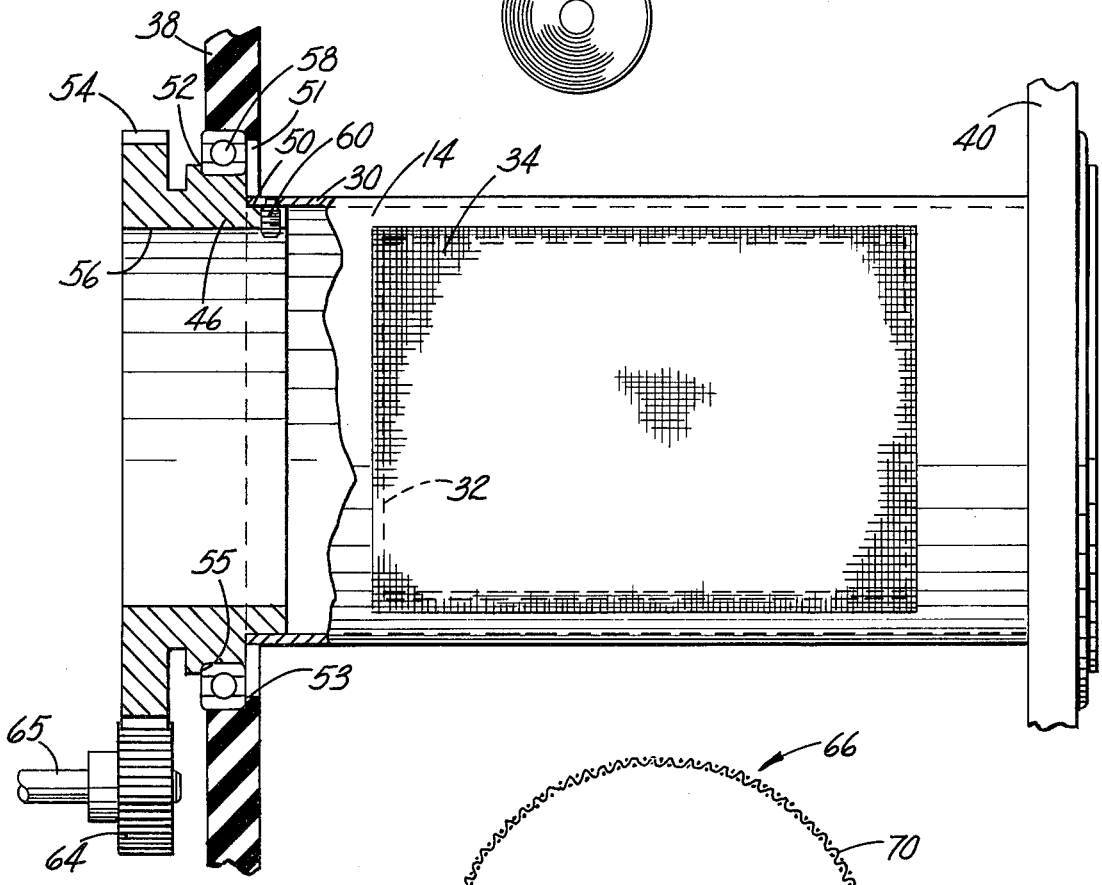
FIG. 2 is a view partially in section of a modulator screen cylinder.

FIG. 2 shows one embodiment of a modulator or photoconductive screen cylinder assembly for use with, for example, an electrostatic duplicating apparatus as described hereinabove with reference to FIG. 1. Other modulator screen cylinders suitable for use with the apparatus of the present invention are described in U.S. Pat. No. 3,985,432 issued on Oct. 12, 1976 in the name of Shou L. Hou and Kenneth F. Taucher, and assigned to the same assignee as this invention. Thus, while a window screen drum is shown and described herein, it is contemplated that cylinders providing a continuous screen surface such as those referred to supra, and also shown in FIG. 3 herein, may also be utilized in the duplicating apparatus of the present invention.

The photoconductive screen cylinder 14 comprises a cylindrical wall 30 having a rectangular window or opening 32 therein and a modulator screen 34 overlying the window 32. The window 32 may be of any desired size as determined by the size of the original document 12 to be copied, and the screen 34 is slightly larger than the window 32 such that the margins of the screen 34 extend beyond the window 32. The screen 34 is secured in place over the window 32 by any suitable means such as cementing or soldering the marginal edges of the screen 34 to the outer surface of the cylindrical wall 30.

The apertured modulator is formed from a metal screen, such as a 200 mesh wire screen having a wire cross section of 0.051 millimeter, and is overcoated with a four-micron thickness of an organic photoconductor, over which is next applied an equal thickness of an insulating layer, such as polystyrene.

Although the screen cylinder 14 of FIG. 2 shown and described herein is provided with only a single window 32, it will be appreciated that the cylinder could be provided with more han a single screened window to provide for the reproduction of a plurality of copies in each revolution of the cylinder 4.

As shown in FIG. 2, the cylinder 14 is rotatably supported in a pair of side plates 38 and 40. Because the support of the cylinder is the same at both ends, only the support at one end of the cylinder is shown and described herein. Also, while the cylinder 14 may be rotatably mounted in any one of several different ways, the arrangement shown herein is somewhat akin to the cylinder mounting described in the hereinabove referred to U.S. Pat. No. 3,985,432.

The side plate 38 rotatably supports therein an end wall member 46 in axial alignment with a similar end wall member rotatably supported in the side plate 40. The end wall member 46 is of circular configuration and comprises a shoulder 50, an annular flange 52, a gear wheel 54 integral with the end wall member 46 and a large diameter bore 56. The shoulder 50 of the end wall member 46 projects inwardly through an opening 51 provided in the side plate 38, and the annular flange 52 is supported in a radial thrust bearing 58, mounted in the opening 51 between an annular lip 53 adjacent the inside face of the side plate 38 and a step shoulder 55 provided on the annular flange 52, for rotatably supporting the end wall member 46 for rotation in the side plate 38. The cylindrical wall 30 of the cylinder 14 is supported on the shoulder 50 and is secured thereto as with screws 60.

The means for rotatably driving the screen cylinder 14 is shown in FIG. 2 and comprises a drive gear 64, which may be fixed directly on a motor drive shaft 65 of a motor not shown in the drawings, in mesh with the gear wheel 54 of the end wall member 46.

If a cylinder having a continuous screen surface is utilized, then the cylinder is preferably driven at both ends such as described in the above U.S. Pat. No. 3,985,432. Thus, although not shown in the drawing, the gear wheel 54 may also be in mesh with a pinion fixed on one end of a shaft which extends the full length of the drum assembly and is parallel to the axis of rotation of the drum. The shaft is rotatably supported in the side plates 38 and 40. A similar pinion is fixed on the other end of the shaft and is in driving engagement with a gear wheel integral with the other end wall member.

With the drive gear 64 in positive relationship with the gear wheel 54, and with pinions in positive driving engagement with the gear wheels 54, there is provided a gear train which simultaneously rotates both ends of the drum in a positive and uniform manner during the imaging and printing operation. Because the pinions are secured on the shaft which is rotatably but firmly supported in the side plates 38 and 40, there is no tendency of vibration or of driving one end of the drum at a velocity different from the other end of the drum. This arrangement of driving both of the end wall members to impart uniform rotation to the screen cylinder assembly eliminates any twisting or distorting of the photoconductive screen, which would result in distorted exposure and printing operations, as might occur if the screen cylinder were driven only at one end.

Figure 3:
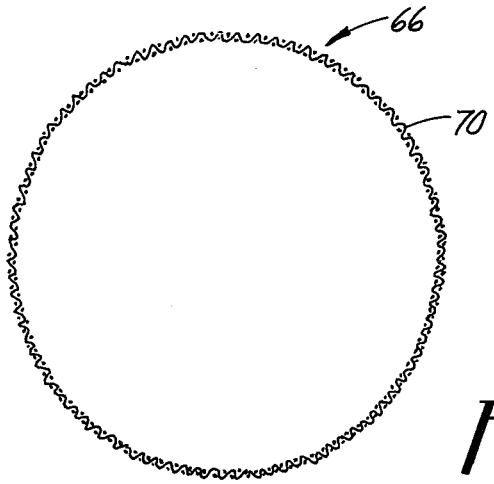
FIG. 3 is an alternate embodiment, in section, of a modulator screen cylinder.

With reference to FIG. 3 there is shown an alternate embodiment of a photoconductive screen cylinder, indicated generally by the reference character 66, wherein the entire periphery of the cylinder comprises a modulator screen 70. This arrangement of the cylinder may also utilize the above screen mounting and support means as well as the drive means for driving both ends of the cylinders.

From the foregoing, it will be appreciated that the present invention provides a modulator screen drum duplicating apparatus for aperture-controlled electrostatic printing. The use of a screen cylinder in a duplicating machine provides for high speed operation for making reproductions of graphic originals. Additionally, the construction of the modulator screen cylinder provides for positive and firm support of the modulator screen resulting in faithful reproductions free of images that are distorted or deformed.

What is claimed is:

1. A duplicating machine for making reproductions of a graphic original on a dielectric material utilizing aperture controlled electrostatic printing techniques, comprising:

photoconductive modulator means formed in the shape of a cylinder comprising a photoconductive layer sandwiched between a metal screen and a transparent insulating layer forming at least a segment of said cylinder;

support means for rotatably supporting said modulator cylinder including means for driving the cylinder;

exposure means for the slit-scan exposure of a stationary graphic original to produce and project a pattern of light and shadow;

means for creating a charge distribution system on the outside surface of said photoconductive modulator cylinder while rotating said cylinder at a first imaging speed, said image corresponding to the pattern of light and shadow projected from said graphic original;

a charge particle imaging station positioned in the path of movement of said cylinder comprising a charge particle generating source within the cylinder and a curved collecting electrode disposed opposite said charge particle generating source and in convex relationship with the outside surface of said cylinder, said collecting electrode having a degree of curvature to produce an electric field between the modulator and the collecting electrode which compensates for curvature of the modulator, said drum rotating at a second speed faster than said first speed during the operation of said charge particle generating source;

a supply of dielectric material;

means for feeding said dielectric material in contact with said collecting electrode for collecting thereon gas ions transmitted by the modulator cylinder; and means for developing the dielectric material to create a visible image thereon.

2. A duplicating apparatus as set forth in claim 1 in which the photoconductive modulator means is made up entirely of said photoconductive layer sandwiched between said metal screen and said transparent insulating layer, including means for receiving and rotatably supporting the lateral edges of the modulator means.

3. A duplicating apparatus as set forth in claim 1 in which photoconductive modulator means comprises a cylindrical wall having at least one opening in its periphery and said photoconductive layer sandwiched between said metal screen and said transparent insulating layer being secured to the cylindrical wall in a position overlying the opening.

4. A method of making reproductions of a graphic original on a dielectric material utilizing a rotatable photoconductive modulator means formed in the shape of a cylinder comprising a photoconductive layer sandwiched between a metal screen and a transparent insulating layer forming at least a segment of said cylinder comprising the steps of mounting said modulator cylinder for rotation and rotating said cylinder at at least two different speeds;

scanning incremental portions of said graphic original and slit exposing said photoconductive modulator to generate a pattern of light and shadow of said graphic original;

projecting said pattern of light and shadow through an optical system onto said modulator cylinder;

generating a charge distribution system on the surface of said modulator cylinder while rotating at a first imaging speed corresponding to the pattern of light and shadow representing the light and dark portions of said graphic original;

projecting charged particles from a particle generating source at a charge particle imaging station onto the surface of said modulator cylinder while it is rotating at a second speed, said station disposed at a fixed position relative to the path of movement of said cylinder with said charge particle generating source positioned inside and adjacent the surface of said cylinder;

collecting said charge particles transmitted by the modulator cylinder on said dielectric material;

controlling the movement of said projected particles emanating from the charge particle generating means within said modulator cylinder to provide a charge pattern that corresponds precisely to said graphic original by providing a curved collecting electrode in convex relation to the modulator cylinder for supporting the dielectric material;

developing the dielectric material to create a visible image thereon.

5. The method as claimed in claim 4 in which photoconductive modulator means is made up entirely of said photoconductive layer sandwiched between said metal screen and said transparent insulating layer, including means for receiving and rotatably supporting the lateral edges of the modulator screen.

6. The method as set forth in claim 4 in which the photoconductive modulator comprises a cylindrical wall having at least one opening in its periphery and said photoconductive layer sandwiched between said metal screen and said transparent insulating layer being secured to the cylindrical wall in a position overlying the opening.

* * * * *